United States Patent [19]

Hokama

[11] Patent Number: 4,559,957

[45] Date of Patent: Dec. 24, 1985

[54] CUTICLE PUSHER

[76] Inventor: Yosh Hokama, 2126 W. 236th St., Torrance, Calif. 90501

[21] Appl. No.: 572,894

[22] Filed: Jan. 23, 1984

[51] Int. Cl.[4] ..... A45D 29/00

[52] U.S. Cl. ..... 132/73; 132/73.5; 132/76.4; 132/93

[58] Field of Search ..... 132/73, 73.5, 75.3, 132/75.6, 76.4, 93, 84 R; D7/141; 15/167 R

[56] References Cited

U.S. PATENT DOCUMENTS

| | | | |
|---|---|---|---|
| 1,289,952 | 12/1918 | Struble | 132/73 |
| 1,451,380 | 4/1923 | Thum | 132/93 |
| 1,586,441 | 5/1926 | Blom | 132/76.4 |
| 2,233,438 | 3/1941 | Troya | 132/76.4 |
| 2,480,446 | 8/1949 | Carlson | 132/73 |
| 2,576,388 | 11/1951 | Claflin | D7/141 |
| 2,801,640 | 8/1957 | Steele | 132/75.6 |
| 3,050,072 | 8/1962 | Diener | 132/93 |
| 3,203,433 | 8/1965 | Miller | 132/75.6 |
| 3,474,481 | 10/1969 | Soleymani et al. | 15/167 R |

*Primary Examiner*—Gene Mancene
*Assistant Examiner*—Carolyn A. Harrison
*Attorney, Agent, or Firm*—William W. Haefliger

[57] ABSTRACT

A cuticle pusher comprises (a) an elongated stem and a cuticle pusher blade at one end of the stem, the blade having an edge facing forwardly and downwardly, and the blade having a downwardly facing side, (b) the stem having, along its length away from the blade, an upwardly arching first section, and a substantially straight and longitudinally extending second section, (c) said first section having an upper side which is convex lengthwise of the stem, and substantially flat, laterally, said upper and under sides angled to conform to the end portions of the user's index and middle fingers, respectively, in both flexed and unflexed conditions of such fingers.

9 Claims, 10 Drawing Figures

FIG. 8.
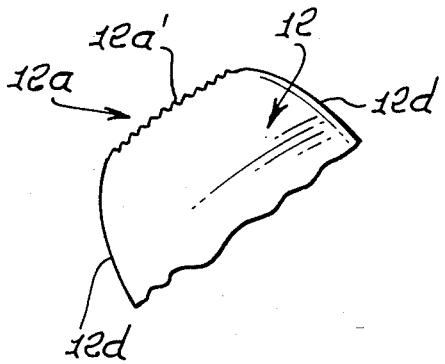
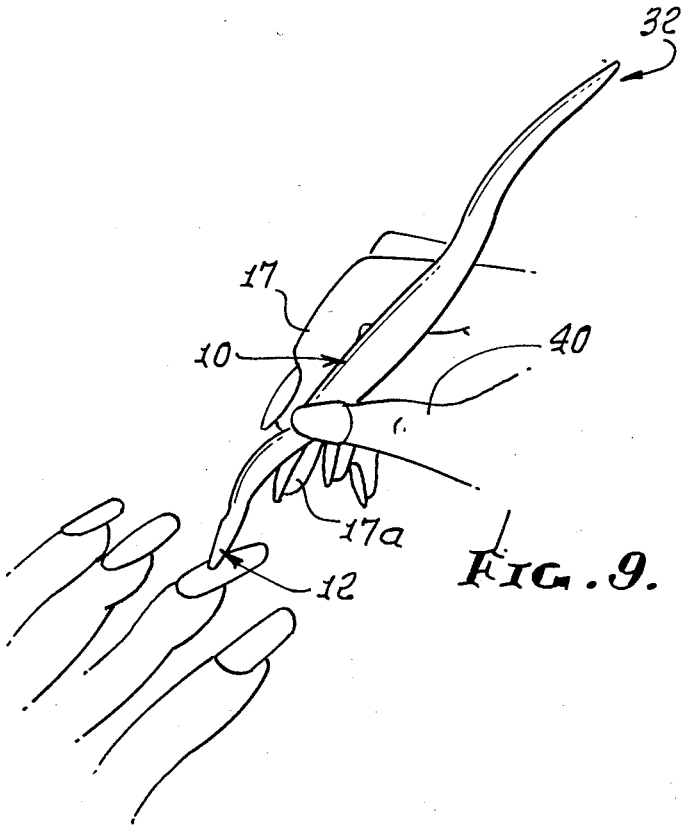
FIG. 9.
FIG. 10.
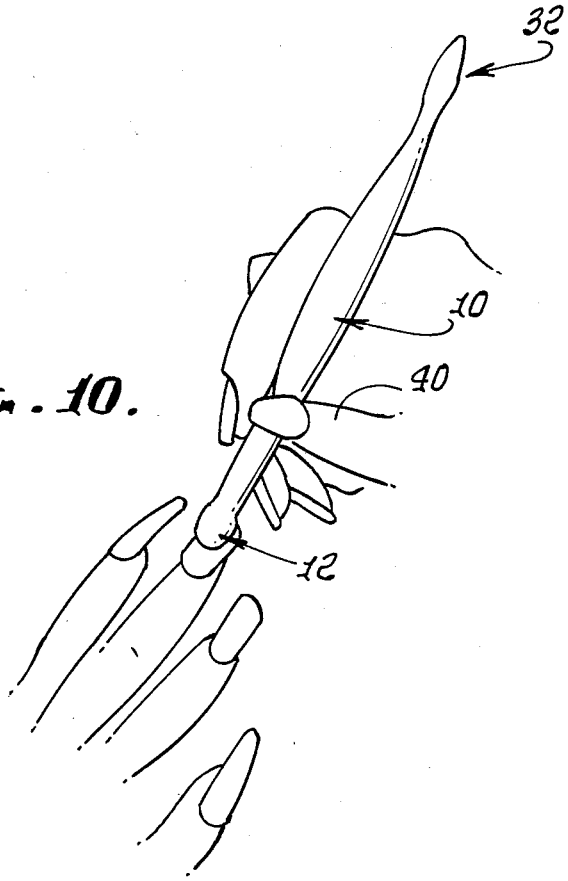

CUTICLE PUSHER

BACKGROUND OF THE INVENTION

This invention relates generally to shaping and removal of cuticle on fingers and toes, and more particularly to a cuticle pusher being characterized by a number of advantages in construction and mode of operation, and providing unusually beneficial results in terms of use.

Manicurists may be regarded as professionals who require excellent tools for shaping and severing cuticle and for applying liquids to fingernails. Prior cuticle pushers, as for example employed brush pushers, or rubber or wooden tips, suffered from deficiencies in construction and design; the latter led to difficulties in holding the pushers, in applying force to the pushers without manual slippage, and in observing the cuticle being manipulated, these being some of the problems encountered.

SUMMARY OF THE INVENTION

It is a major object of the invention to provide a cuticle pusher device of improved construction and design characterized as overcoming the above referenced deficiencies, and meeting the practical needs of manicurists. Basically, the improved pusher comprises, in combination:

(a) an elongated stem and a cuticle pusher blade at one end of the stem, the blade having an edge facing forwardly and downwardly, and the blade having a downwardly facing side, (b) the stem having, along its length away from the blade, an upwardly arching first section, and a substantially straight and longitudinally extending second section, (c) the first section having an upper side which is convex lengthwise of the stem, and substantially flat, laterally, said upper and undersides angled to conform to the end portions of the user's index and middle fingers, respectively, in both flexed and unflexed conditions of such fingers.

As will be seen, the convex upper side of the arched section may be serrated to prevent slippage of the index finger; and the middle finger of the user rests flatly against the concave under surface of the arched section. In addition, the blade typically extends forwardly and downwardly in a continuation of the arched first section and at an angle of between about 8° and 20° related to a longitudinal axis defined by the second section, enabling the user to clearly observe cuticle being pushed.

Additional advantages include the provision of a blade having a smooth upper surface which is flat lengthwise, and upwardly convex, laterally, to conform to the nail cuticle shape, and also to enable effective patting of liquid mixtures applied to the nail; the provision of a blade forward edge defining minute serrations for cutting cuticle; the provision of a pusher consisting of dark, hard plastic for strength and resistance to bending, and for contrast with lighter shaded nails; and the provision of a nail cleaning tapered tip at the opposite end of the stem, and beyond a third section of the stem which is also arched upwardly, as will appear. Accordingly, the overall device has a gull-wing shape.

These and other objects and advantages of the invention, as well as the details of an illustrative embodiment, will be more fully understood from the following description and drawings, in which:

DRAWING DESCRIPTION

FIG. 8 is an enlarged and fragmentary plan view of the cuticle pusher blade;

FIG. 9 is a perspective view showing a first person's use of the cuticle pusher during application of the blade to cuticle on a finger of a second person;

FIG. 10 is a perspective view showing a first person's use of the cuticle pusher during application of the blade to cuticle on a finger of the user.

DETAILED DESCRIPTION

Figure 1:
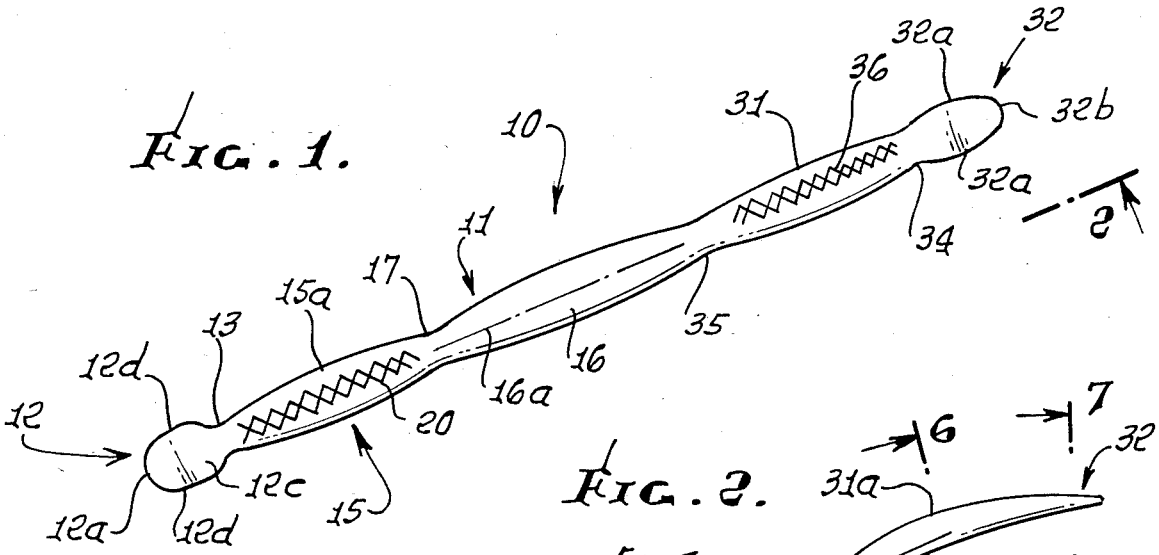
FIG. 1 is a top plan view of a cuticle pusher incorporating the invention.
Figure 2:
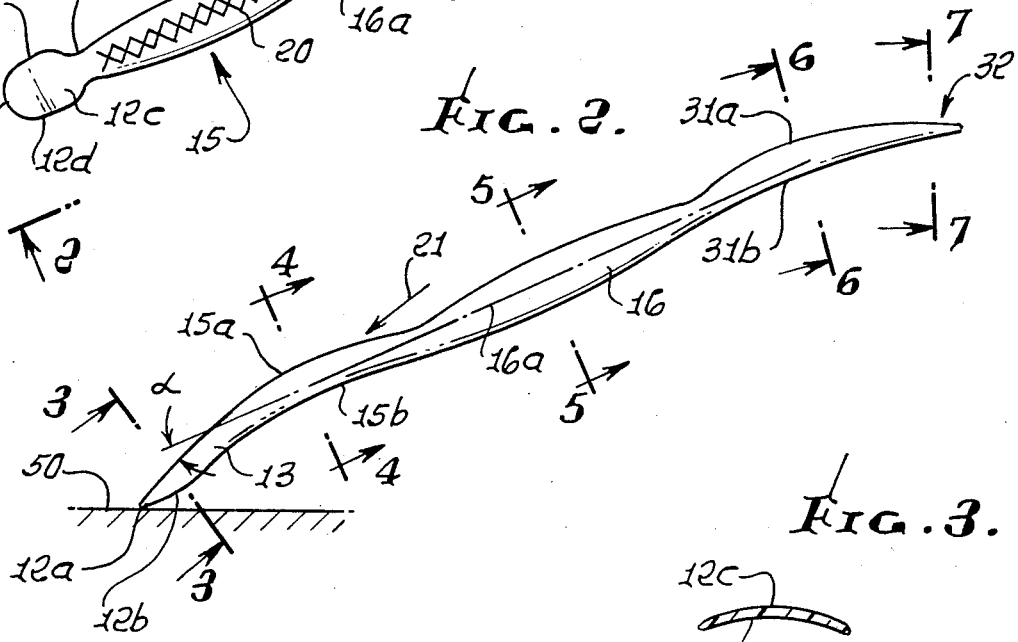
FIG. 2 is a side view on lines 2—2 of FIG. 1.
Figure 3:
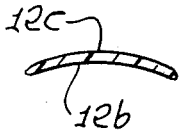
FIGS. 3–7 are enlarged sections on lines 3—3, 4—4, 5—5, 6—6 and 7—7 of FIG. 2.
Figure 6:
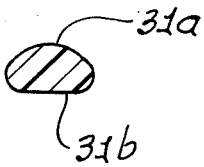
Figure 4:
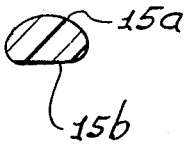
Figure 7:
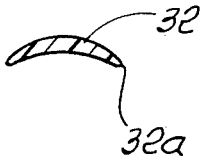

Referring to FIGS. 1–8, the molded plastic cuticle pusher 10 comprises an elongated stem 11 and a blade 12 at one end of the stem and integrally attached to the latter at neck 13. In FIG. 2, the blade edge 12*a* faces forwardly and downwardly, and the blade has a downwardly facing underside 12*b*. In this view, the pusher is oriented, as in use, relative to a fingernail 50 which extends horizontally.

Figure 5:
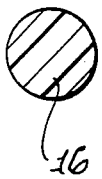

The stem has, along its length away from the blade, an upwardly arched first section 15, and a substantially straight second section 16. In the FIG. 1 plan, the sections merge at a narrowed region or first zone 17. Second section 16 has a longitudinal axis 16*a*, and may have circular cross sections along its length, as shown in FIG. 5.

The first section 15 has an upper side 15*a* which is shallowly convex lengthwise of the section, and an underside 15*b* which is shallowly concave lengthwise of the section. Also, underside 15*b* is substantially flat, laterally, as appears in FIG. 4. Thus, sides 15*a* and 15*b* are angled to conform to the end portions of the user's index and middle fingers 17 and 17*a*, respectively in both unflexed and flexed conditions of said fingers. See FIGS. 9 and 10.

The blade upper surface 12*c* extends downwardly and forwardly from neck 13 toward cuticle pushing edge 12*a*, as a continuation of the upper surface of the arched section 15, and at a downward angle $\alpha$ of between 8° and 20° relative to axis 16*a*. That upper surface 12*c* of the blade is flat lengthwise of the blade and shallowly concave, laterally, as is clear from FIG. 3. Accordingly, the blade upper surface may be used to pat down liquid mixtures applied to an upper surface of the fingernail 50, as when the tool is rotated to upside down position. FIG. 1 shows that the blade has lateral edges 12*d* which approximate the blade length between neck 13 and edge 12*a*. Edges 12*d* convexly merge with edge 12*a*, as shown. Forward edge 12*a* may advantageously define tiny or minute serrations indicated at 12*a*′ in enlarged plan view as seen in FIG. 8, for cutting cuticle. Blade under surface 12*b* is upwardly shallowly concave, laterally, as appears in FIG. 3, to conform generally to the curvature of a fingernail at the cuticle regions.

The convex upper side or surface 15*a* of section 15 is serrated or grooved, as indicated at 20, along the length of surface 15*a* and at opposite sides of the crest. Accordingly, the user's index finger does not slip when pressing against the surface 15*a* to transmit forward force to push blade 12 toward and against cuticle. Such force is indicated by arrow 21 in FIG. 2. The opposite and underside 15*b* of the section 15 confortably supports the user's middle finger during such force application. See FIGS. 9 and 10.

Note in FIGS. 9 and 10 that the cuticle pusher blade is dark colored, and typically black, to provide visual contrast with the light coloring of the nail at the cuticle region, thereby aiding in observing the degree of cuticle displacement.

FIG. 9 shows use of the cuticle pusher, with the index and middle fingers relatively unflexed, as during treatment of a manicurist's client's fingernails. FIG. 10 shows use of the cuticle pusher, with the index and middle fingers flexed, and the pusher rotated, as during treatment of the user's own fingernails. Thumb 40 engages round area 17.

An additional advantage is the provision of a forwardly tapering nail cleaning tip 32 projecting rearwardly at the opposite end of the stem. The stem includes, along its length away from the tip 32, an upwardly shallowly arching third section 31 merging with the tip 32 at neck 34, and with the second section 16 at neck or second zone 35. Section 31 is like first section 15, and has surfaces 31*a* and 31*b* corresponding to surfaces 15*a* and 15*b*, for engagement with the user's index and middle fingers, when tip 30 is being employed. Note also serrations 36 corresponding to serrations 20. Tip 32 has opposite lateral edges 32*a* tapering toward point 32*b*. The overall device therefore has gull-wing shape.

Finally, as shown in the drawings, zones 17 and 35 are reduced relation to the maximum cross sections of the first, second and third sections 15, 16 and 31. Also the first and third sections 15 and 31 are substantially elliptical in cross section (see FIGS. 4 and 6).

I claim:

1. In a cuticle pusher, the combination comprising:

(a) an elongated stem and a cuticle pusher blade at one end of the stem, and a rearwardly tapering nail cleaning tip at the opposite end of the stem, the blade having an edge facing forwardly and downwardly, and the blade having a downwardly facing side, (b) the stem having, along its length away from the blade, an upwardly arching first section, a substantially straight and longitudinally extending second section merging at a first zone with said first section, and an upwardly arching third section merging with said tip and also merging with said second section at a second zone, (c) said first section having an upper side which is convex lengthwise of said section and an underside which is concave lengthwise of said section, and substantially flat, laterally, said upper and under sides angled to conform to the end portions of the user's index and middle fingers, respectively, in both flexed and unflexed conditions of such fingers, (d) and said third section also having an upper side which is convex lengthwise of said section, and an underside which is concave lengthwise of the stem and is substantially flat, laterally, said third section upper and under sides angled to conform to the end portions of the user's index and middle fingers, respectively, in both flexed and unflexed conditions of such fingers, (e) said first and second zones having cross sections which are reduced relative to the maximum cross sections of said first, second and third sections, (f) said first and third sections being substantially elliptical in cross section.

2. The cuticle pusher of claim 1 wherein the convex upper side of said upwardly arching first section is serrated.

3. The cuticle pusher of claim 1 wherein said blade extends forwardly and downwardly in a continuation of said arched first section and at a downward angle $\alpha$ of between about 8° and 20° relative to an axis defined by said straight second section.

4. The cuticle pusher of claim 3 wherein the blade has a smooth upper surface which is flat lengthwise of the blade and which is upwardly convex, laterally.

5. The cuticle pusher of claim 4 wherein the blade has an under surface which is upwardly concave, laterally.

6. The cuticle pusher of claim 1 which consists of hard plastic material, the blade being dark.

7. The cuticle pusher of claim 1 wherein the blade forward edge defines minute serrations for cutting cuticle.

8. The cuticle pusher of claim 1 wherein the convex upper side of said upwardly arching third section is serrated.

9. The cuticle pusher of claim 8 wherein the cuticle pusher has gull-wing configuration, along its length.

* * * * *